US011359358B1

(12) United States Patent
Timms

(10) Patent No.: US 11,359,358 B1
(45) Date of Patent: Jun. 14, 2022

(54) FREEZE FRAME

(71) Applicant: Lisa Jordan Timms, Mansfield, TX (US)

(72) Inventor: Lisa Jordan Timms, Mansfield, TX (US)

( * ) Notice: Subject to any disclaimer, the term of this patent is extended or adjusted under 35 U.S.C. 154(b) by 0 days.

(21) Appl. No.: 17/060,109

(22) Filed: Oct. 1, 2020

Related U.S. Application Data

(60) Provisional application No. 63/049,348, filed on Jul. 8, 2020.

(51) Int. Cl.
*E03B 7/12* (2006.01)
*E03B 7/09* (2006.01)
*E03B 9/02* (2006.01)

(52) U.S. Cl.
CPC ..... *E03B 7/12* (2013.01); *E03B 7/095* (2013.01); *E03B 9/025* (2013.01); *E03B 9/027* (2013.01); *Y10T 137/698* (2015.04); *Y10T 137/7036* (2015.04)

(58) Field of Classification Search
CPC .... E03B 7/095; E03B 7/12; E03B 9/025–027; Y10T 137/698; Y10T 137/7062; Y10T 137/7036; F16K 27/12
See application file for complete search history.

(56) References Cited

U.S. PATENT DOCUMENTS 3,722,533 A * 3/1973 Connolly ..... F16K 27/12 137/382
4,244,394 A * 1/1981 Hartselle, III ..... F16K 27/12 137/375
4,577,655 A * 3/1986 Carroll ..... F16K 49/00 137/375
5,964,246 A * 10/1999 Meeker ..... E03B 7/12 137/360
6,079,439 A * 6/2000 Hartley ..... E03B 7/095 137/375
6,145,534 A * 11/2000 Romero ..... E03C 1/041 137/377
9,261,203 B2 * 2/2016 Vulpitta ..... F16K 35/10
2001/0022302 A1 * 9/2001 Dunn ..... B65D 90/501 220/62.11
2004/0084086 A1 * 5/2004 Stachowiak ..... F16K 27/12 137/382
2005/0247009 A1 * 11/2005 Vagedes ..... F16K 27/12 52/698
2006/0144844 A1 * 7/2006 Kita ..... B65D 37/00 220/592.2

* cited by examiner

*Primary Examiner* — Kevin F Murphy

(57) ABSTRACT

A freeze frame to protect an outdoor faucet and hose when the outside temperature dips below freezing is disclosed. The frame comprises a first box and a second box. The two boxes are held-together using one or more spring-loaded hinge. The first box has a cavity and a pair of padlock tabs at its upper portion. The second box comprises a cavity and a pair of lock hasps at its lower portion. The cavity of each box forms a hole, which allows the hose to remain connected to the hose bib. The frame further comprises a closed-cell foam gasket with one or more mounting flanges. The gasket is configured to mount the second box to the dwelling wall using one or more fasteners. The first box is configured to cover and secure the water pipe connection surrounded by the second box.

13 Claims, 5 Drawing Sheets

FREEZE FRAME

BACKGROUND OF THE INVENTION

A. Technical Field

The present invention generally relates to household products. More specifically, the present invention relates to a frame, configured to protect an outdoor faucet when the outside temperature dips below freezing.

B. Description of Related Art

Any system that conveys fluids for almost any application requires some plumbing to carry out that task with any efficiency. Many ancient civilizations around the world have utilized plumbing to different degrees. The Romans have reached the apex of early plumbing by the use of expansive systems for aqueducts, tile wastewater removal systems, and widespread use of lead piping. Later, interior plumbing has developed and became widespread, where rural areas are the last to realize indoor plumbing, especially the toilets and wastewater disposal systems.

With the advent of indoor plumbing advances, the outdoor plumbing fixtures are integrated into the structure of homes and businesses. In the early days, outdoor plumbing is incorporated into buildings. The indoor plumbing designs of structures often require the exterior fixtures to be added to structures when constructed. The exterior plumbing fixtures are very convenient, especially for keeping gardens watered and other uses of an outside water source.

Faucets attached to structures and houses have exposure to weather and freezing temperature during cold weather. A popular solution that many people use is the addition of a foam cover that attaches to the exterior faucet. The foam cover is obtained from the usual home improvement stores and is attached to the plumbing utilizing a rubber band that is attached to the faucet. The cover is drawn tight around the valve using the mechanism that comes with the cover. The primary issue of these faucet covers is the task of remembering to attach them when cold weather is threatening. There is also the hassle of removing and storing them in warmer weather. The covers are usually damaged or lost during summertime and often have to be purchased every year. The cover also offers no form of security for the water faucet since anyone can remove them and either use the water and remove the cover.

Currently, the homeowner/landscaper must be very vigilant and must remove any attached hoses that are attached to outdoor faucets when the outside temperature dips below freezing. If the hose allows the faucet to freeze, most likely, the pipe feeding the faucet could be damaged, and when the outside temperature warms up above freezing, the damaged pipe could thaw. Further, due to the damage is within the wall, it could flood a large area in the dwelling before being detected. This could lead to serious structural damage and very large repair bills.

In light of the above-mentioned problems, there is an insulative box or frame to cover the faucet and hose mounted on the outside wall of the building. Also, there is a need for a solution to secure the attached hose from vandalism and/or theft.

SUMMARY OF THE INVENTION

The present invention generally discloses household products. Further, the present invention discloses to a freeze frame, configured to protect an outdoor faucet and hose when the outside temperature dips below freezing.

According to the present invention, the freeze frame is an innovative household product that has been designed to protect the outside faucet from freezing, while keeping it and the attached hose secure from vandalism and/or theft. In one embodiment, the frame is an intelligent solution to cover the exterior faucet or hose bib and hose during cold temperatures and secures the water supply using a lock. In one embodiment, the frame is an insulative box configured to cover the faucet or hose bib and hose, and sealed against the outside wall of the building/dwelling.

In one embodiment, the frame comprises two boxes includes a first box or upper box and a second box or lower box. In one embodiment, each box is constructed using an insulating polymer that has been molded into a 3" wide by 6" tall by 3" deep box shape, which is coated with a 2-part epoxy sealant and then employs a built-up inner and outer wall of resin for strength. In one embodiment, the two boxes are held-together using one or more spring-loaded hinge. In one embodiment, the second box is mounted to the dwelling wall, whereas the first box acts as a lid for the second box configured to cover and secure the water pipe connection.

In one embodiment, the first box has an opening or cavity and a pair of padlock tabs or mating edge at its upper portion. In one embodiment, the second box comprises an opening or cavity and a pair of lock hasps or mating edges at its lower portion. In one embodiment, the mating edges are coated with a thin gasket molded from RTV silicone rubber. In one embodiment, the cavity of each box allows the water hose to remain connected to the outdoor hose bib. The frame offers year-round protection of the exterior faucet, and when closed, the frame could be locked using the mounting surface.

In one embodiment, the frame further comprises a closed-cell foam gasket with one or more mounting flanges or mounting tables at the back of the second box. The gasket is an insulating adhesive gasket that seals the open back of the second box to the dwelling wall surface. In one embodiment, the second box has provisions for mounting with wood screws or expansion bolts for brick or stone walls. The gasket also insulates, seals, and mounts the product as well as holds the second box to the wall. In one embodiment, the gasket has four mounting flanges with holes configured to mount the second box to the call surface using fasteners. The fasteners could be threaded screws, nuts, and bolts. In one embodiment, the mounting flanges allow easy attachment of the second box to the dwelling wall.

In one embodiment, the first box has a closed back surface to protect the hose bib and attached hose when closed. In one embodiment, the second box has t open back to fit around the hose bib and is sealed against the dwelling wall with the closed-cell foam gasket, making it weatherproof. In one embodiment, the dwelling wall could be of any typical construction, brick, shiplap, batten board, stucco, etc., and the foam gasket has enough compliance to make a good seal. The gasket is supplied with adhesive and shielding paper on both mating surfaces. Further, the construction of the frame allows it to remain installed all year around, thereby eliminating the installation of the frame for winter and removed for summer like competitive products. The frame is very durable and could be deployed for many years without degradation.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
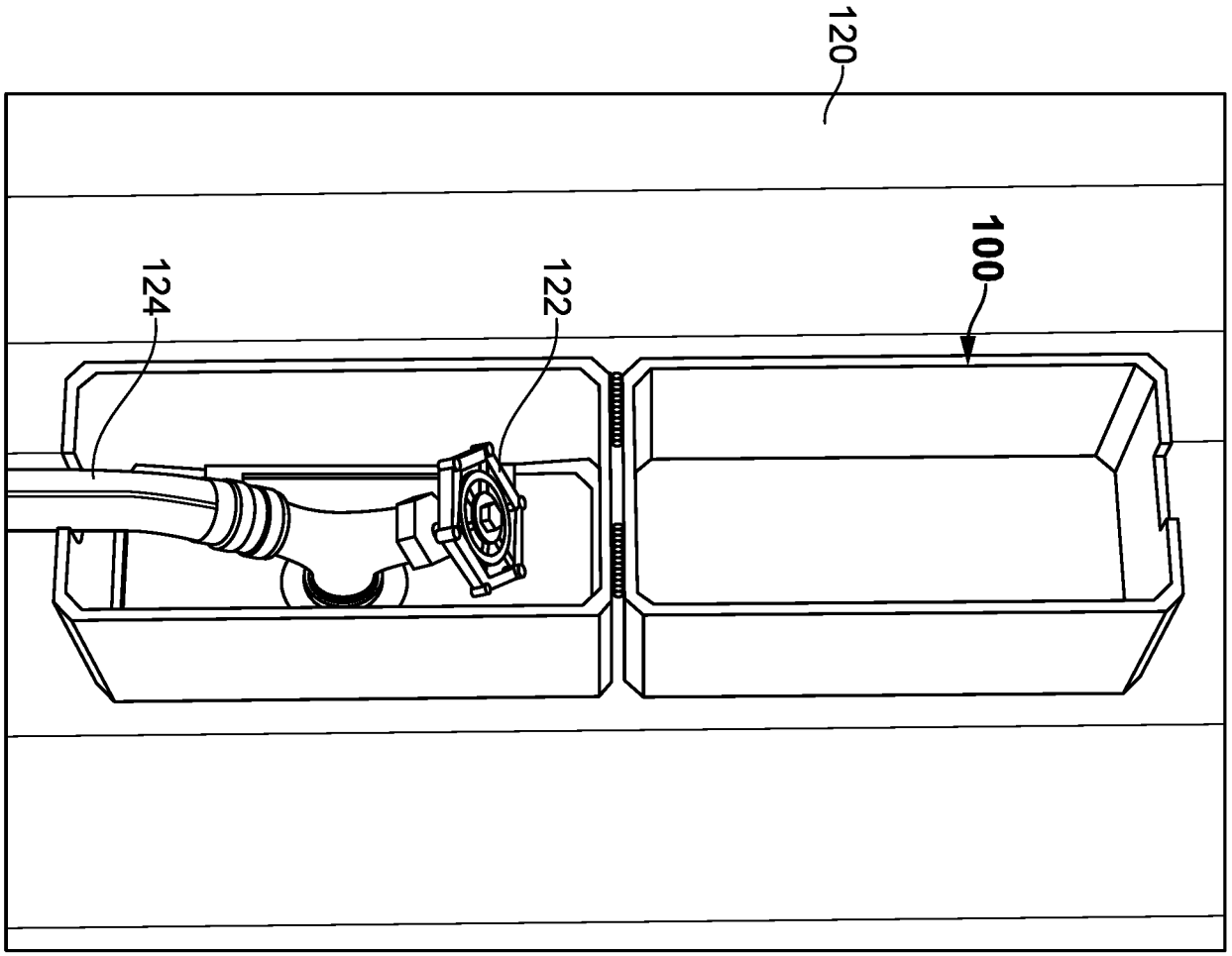
FIG. 1 shows a freeze frame configured to protect an outdoor faucet in an open position in a typical use case in an embodiment of the present invention.
Figure 2:
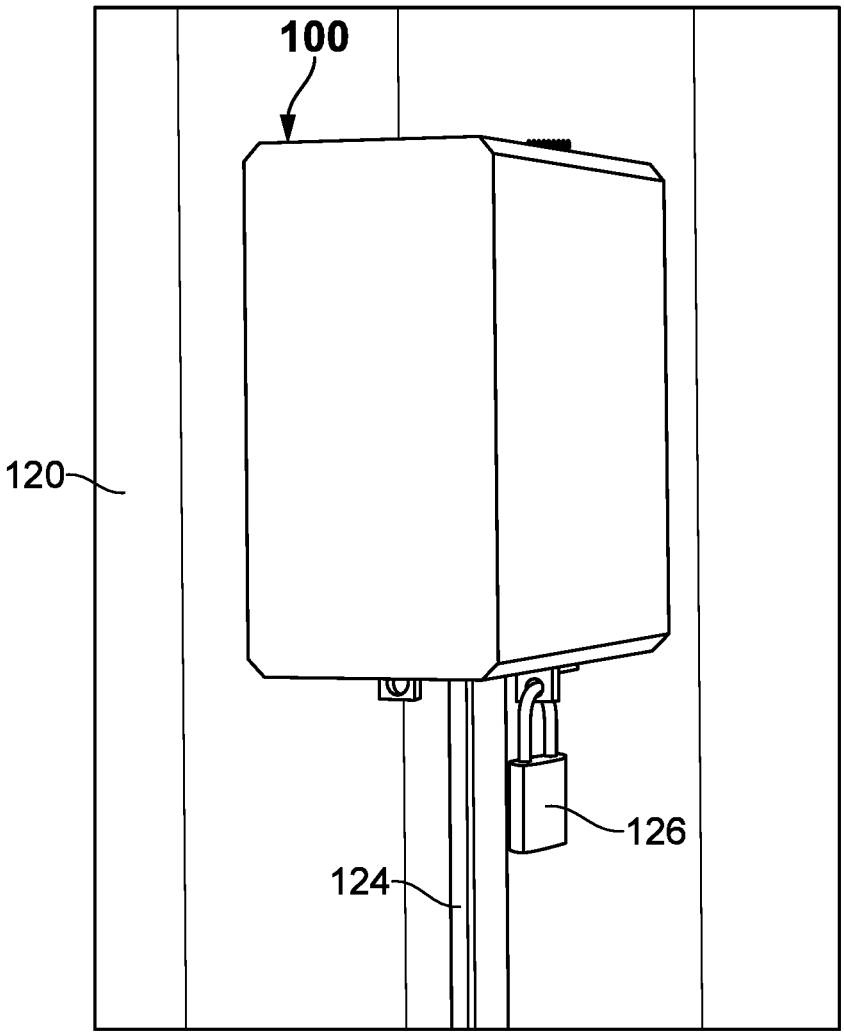
FIG. 2 shows a perspective view of the freeze frame in a locked position in one embodiment of the present invention.

Referring to FIGS. 1 and 2, a freeze frame 100 mounted on a dwelling wall 120 configured to protect an outdoor faucet or hose bib 122 and a hose 124 in a typical use case, according to an embodiment of the present invention. In one embodiment, the frame 100 is an innovative household product that has been designed to protect the outside faucet from freezing, while keeping it and the attached hose secure from vandalism and/or theft. In one embodiment, the frame 100 is an intelligent solution to cover the exterior faucet or hose bib 122 and hose 124 during cold temperatures and secures the water supply using a lock 126. the In one embodiment, the frame 100 is an insulative box configured to cover the faucet or hose bib 122 and hose 124, and sealed against the outside wall 120 of the building/dwelling.

Figure 3:
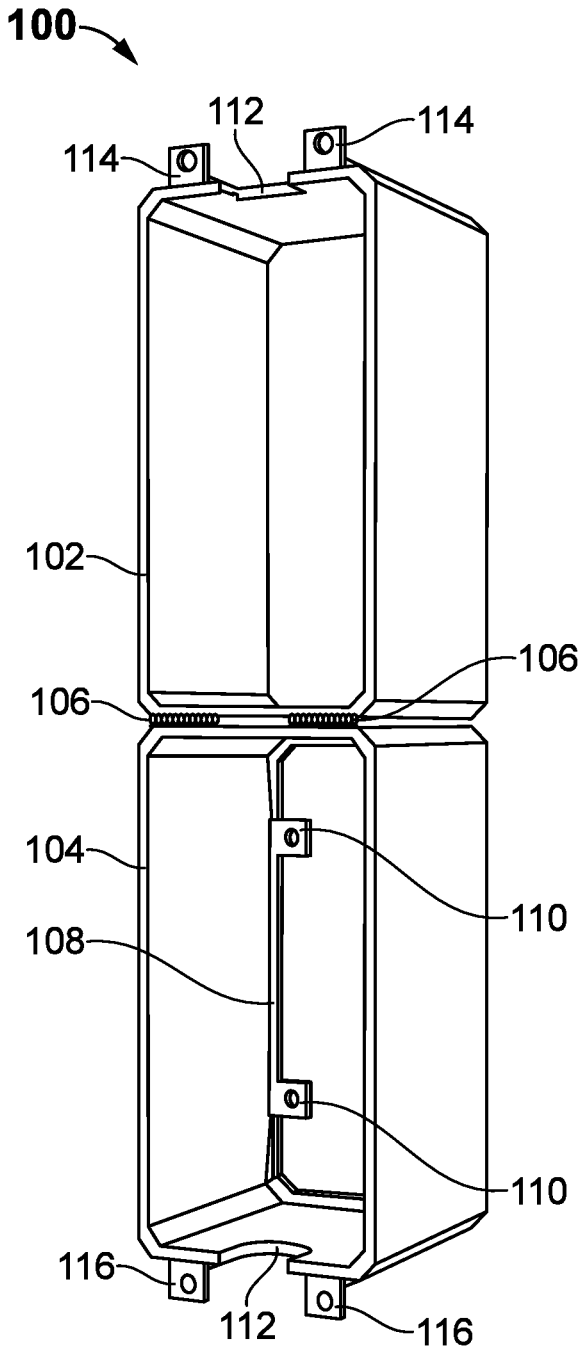
FIG. 3 shows a perspective view of the freeze frame in one embodiment of the present invention.

Referring to FIG. 3, a perspective view of the frame 100, according to one embodiment of the present invention. In one embodiment, the frame 100 comprises two boxes includes a first box or upper box 102 and a second box or lower box 104. In one embodiment, each box (102 and 104) is constructed using an insulating polymer that has been molded into a 3" wide by 6" tall by 3" deep box shape, which is coated with a 2-part epoxy sealant and then employs a built-up inner and outer wall of resin for strength. In one embodiment, the two boxes (102 and 104) are held-together using one or more spring-loaded hinge 106. In one embodiment, the second box 104 is mounted to the dwelling wall 120, whereas the first box 102 acts as a lid for the second box 104 configured to cover and secure the water pipe connection.

In one embodiment, the first box 102 has an opening or cavity 112 and a pair of padlock tabs or mating edge 114 at its upper portion. In one embodiment, the second box 104 comprises an opening or cavity 112 and a pair of lock hasps or mating edges 116 at its lower portion. In one embodiment, the mating edges (114 and 116) are coated with a thin gasket molded from RTV silicone rubber. In one embodiment, the cavity 112 of each box allows the water hose 124 to remain connected to the outdoor hose bib 122. The frame 100 offers year-round protection of the exterior faucet, and when closed, the frame could be locked using the mating edges (114 and 116).

In one embodiment, the frame 100 further comprises a closed-cell foam gasket 108 with one or more mounting flanges or mounting tables 110 at the back of the second box 104. The gasket 108 is an insulating adhesive gasket that seals the open back of the second box 104 to the dwelling wall surface 120. In one embodiment, the second box 104 has provisions for mounting with wood screws or expansion bolts for brick or stone walls. The gasket 108 also insulates, seals, and mounts the product as well as holds the second box 104 to the dwelling wall 120. In one embodiment, the gasket 108 has four mounting flanges 110 with holes configured to mount the second box 104 to the dwelling wall surface 120 using fasteners. The fasteners could be threaded screws, nuts, and bolts. In one embodiment, the mounting flanges 110 allow easy attachment of the second box 104 to the dwelling wall 120.

Figure 4:
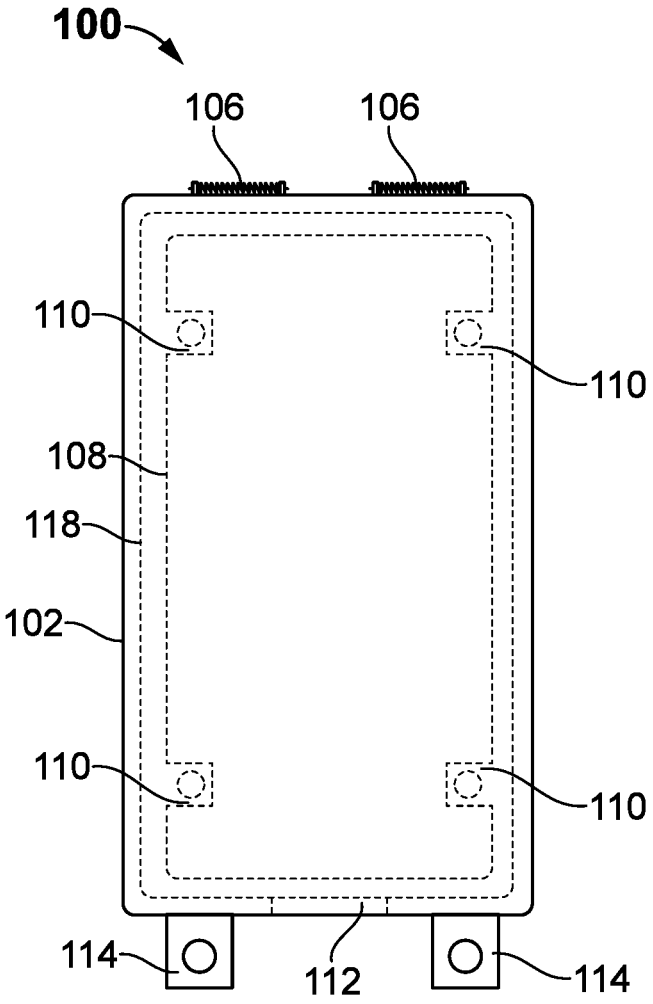
FIG. 4 shows a front view of the freeze frame in one embodiment of the present invention.
Figure 5:
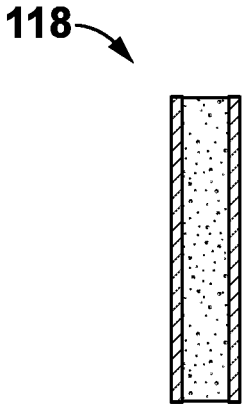
FIG. 5 shows a cut-sectional view of a frame wall in one embodiment of the present invention.

Referring to FIG. 4, a front view of the frame 100 in the closed position is disclosed. The frame 100 comprises the first box 102 and the second box 104. In one embodiment, the frame 100 is a 3" wide by 6" tall hinged box that mounts on the wall 120 with the adhesive foam gasket 108 or the supplied screws, or both. In one embodiment, the box walls 118 are molded using polystyrene foam that has been clad with 2-part epoxy and then coated with resin to buildup the inner and outer walls for strength while enhancing the insulative values. FIG. 5 shows a cut-sectional view of wall 118, according to one embodiment of the present invention.

In one embodiment, the first box 102 comprises a pair of padlock tabs or mating edges 114. In one embodiment, the second box 104 comprises a pair of lock hasps mating edges 116. The mating edges (114 and 116) are coated with a thin film of silicone rubber to make a seal between the joins. The spring-loaded hinges 106 force the 2 boxes (102 and 104) together, preventing drafts and powdery snow from drifting into the cavity. In one embodiment, the frame 100 has about twice the insulating capability as a non-insulated plastic walled box and has similar strength. The front of the frame 100 could be printed with a logo of almost any image or a standard logo and other product specifications. The frame 100 could be secured with the padlock through the mating flanges, which prevents any tampering. In one embodiment, the frame 100 comprises a hole formed by the cavities 112 of the first box 102 and second box 104. In one embodiment, the hole has a dimension of about 1.5" diameter, which is molded into the wall below the hose bib 122, allowing the hose 124 to pass through without separating protective box halves (102 and 104). The hole 112 is a circular opening with a 0.75" radius, centered on the center-line of the frame 100 and the box join. Further, a molded Buna-n rubber plug is supplied to fill this cavity from letting drafts in if the hose 124 is not attached.

Figure 6:
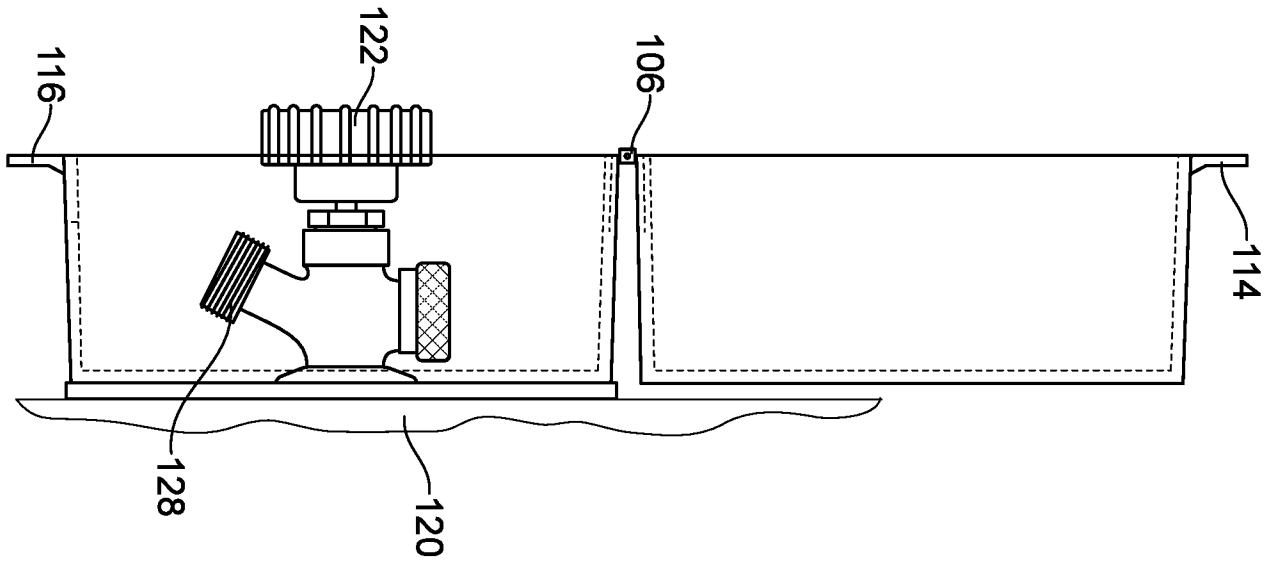
FIG. 6 shows a side view of the freeze frame in one embodiment of the present invention.

Referring to FIG. 6, a side view of the frame 100 is disclosed. In one embodiment, the use of frame 100 allows the hose 124 to be left attached to the hose bib 122 even when the outside temperature gets below freezing. In one embodiment, the spring-loaded hinges 106 hold the first box 102 tightly against the second box 104 slightly compressing the thin silicone rubber surfaces to maintain a seal. The hardened solid plastic padlock tab is reinforced to make it strong enough to resist most tampering efforts. In one embodiment, the first box 102 has a closed back surface to protect the hose bib 122 and hose 124 attached via a connector 128 when closed.

In one embodiment, the second box 104 has t open back to fit around the hose bib 122 and is sealed against the dwelling wall 120 with the closed-cell foam gasket 108, making it weatherproof. In one embodiment, the dwelling wall 120 could be of any typical construction, brick, shiplap, batten board, stucco, etc., and the foam gasket 108 has enough compliance to make a good seal. The gasket 108 is supplied with adhesive and shielding paper on both mating surfaces. Further, the construction of the frame 100 allows it to remain installed all year around, thereby eliminating the installation of frame 100 for winter and removed for summer like competitive products. The frame 100 is very durable and could be deployed for many years without degradation.

According to the present invention, the frame 100 is fabricated, but not limited to, the following materials and processes. The frame 100 is fabricated using an insulating polystyrene resin that has been foam molded into a 3" wide by 6" tall by 3" deep box shape. The frame 100 is coated with a vibrant colored 2-part epoxy sealant and then applies a built-up inner and outer wall of resin for strength. After molding, the frame 100 is sprayed with a 5-mil thick coating of 2-part urethane hard shell foam coating, which is followed with a dip coating of 2-part epoxy resin hard shell foam coating to form a thicker wall (~25-mils each side) for strength. The mating edges (114 and 116) are formed in this process as well.

In one embodiment, the frame 100 could be printed with the logo at the front outer surface. The logo is silk-screened onto the outer surface at this time. After the frame 100 is coated, the commercially available spring-loaded stainless-steel hinge 106 is mounted on the frame 100 and adhesively bonded in place and the RTV silicone rubber gasket 108 is applied and smoothed to a flat surface on both boxes (102 and 104). Then the closed-cell foam gasket 108 is stamped out using a steel rule die and flywheel press. After fabrication of all the components, gasket 108, hinge joined box 106, and mounting fasteners are gathered and placed in the point-of-sale packaging. In one embodiment, the frame 100 could be supplied in almost any vibrant color, so a distinctive color could be chosen to enhance the product recognition factor, which could dramatically improve the market adoption of the product. The standard color is light beige to blend into typical house decoration purposes.

Advantageously, the frame helps the home or business owner to prevent the freezing of exterior faucets of any type. The frame insulates and retains the heat, transmitted from inside the dwelling down the pipe feeding the faucet, preventing the faucet from freezing. The frame is very durable and could be left on the building all year round. The frame allows almost any garden hose to remain attached to the hose bib, regardless of the ambient temperature, thereby allowing easy access to water year-round to irrigate the landscaping, trees, etc. The frame is also supplied with tabs that allow a padlock to secure the boxes in the closed position, thereby preventing unauthorized use and vandalism. The frame also improves the security of the outdoor water faucet by providing the user with locking means.

Further, the freeze frame is designed to be aesthetic and effective in the application. The relative ease of manufacture and the moderately inexpensive components provide good marketability for the manufacturer. The user benefits from the greatly reduced incidence of the faucet/hose freezing and increased security, which could provide considerable market interest in the product.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. A protective device to protect an outside faucet of a building from freezing, comprising:

an insulating box configured to cover the outside faucet and to seal the outside faucet against an outside wall of the building;

wherein the insulating box includes an upper box and a lower box;

a hose configured to extend though the insulating box and connect to the outside faucet; and an aperture to allow the hose to extend though the insulating box and remain connected to the outside faucet.

2. A protective device to protect the outside faucet of a building from freezing as in claim 1, wherein the insulating box is formed from an insulating polymer.

3. A protective device to protect the outside faucet of a building from freezing as in claim 1, wherein the insulating box is coated with a 2-part epoxy sealant.

4. A protective device to protect the outside faucet of a building from freezing as in claim 1, wherein the insulating box includes an inner wall being coated with resin for strength and an outer wall being coated with resin for strength.

5. A protective device to protect the outside faucet of a building from freezing as in claim 4, wherein the upper box and the lower box are connected with a spring-loaded hinge.

6. A protective device to protect the outside faucet of a building from freezing as in claim 4, wherein the lower box is mounted to the building wall, and the upper box forms a lid for the lower box and wherein the lower box is configured to cover and secure a water pipe connection.

7. A protective device to protect the outside faucet of a building from freezing as in claim 4, wherein the upper box includes an upper opening to align with a lower opening of the lower box to allow a hose to connect to the outside faucet.

8. A protective device to protect the outside faucet of a building from freezing as in claim 4, wherein the upper box is lockable to the lower box.

9. A protective device to protect the outside faucet of a building from freezing as in claim 4, wherein the upper box includes a closed back surface to protect the hose when closed.

10. A protective device to protect the outside faucet of a building from freezing as in claim 4, when the lower box includes an open back which is sealed against the building wall.

11. A protective device to protect the outside faucet of a building from freezing as in claim 1, wherein the insulating box includes a mounting flange to mount the insulating box on the outside wall of the building.

12. A protective device to protect the outside faucet of a building from freezing as in claim 1, wherein the insulating box includes a gasket to seal the insulating box to the outside wall of the building.

13. A protective device to protect the outside faucet of a building from freezing as in claim 12, wherein the gasket includes an adhesive.

* * * * *